United States Patent [19]

Weiss

[11] Patent Number: 4,572,500

[45] Date of Patent: Feb. 25, 1986

[54] ROWING EXERCISE DEVICE

[76] Inventor: Eugene Weiss, 937 Saw Mill River Rd., Yonkers, N.Y. 10710

[21] Appl. No.: 633,473

[22] Filed: Jul. 23, 1984

[51] Int. Cl.[4] ..... A63B 69/06; A63B 21/14; A63B 21/00

[52] U.S. Cl. ..... 272/72; 272/130; 272/127

[58] Field of Search ..... 272/72, 73, 130, 120, 272/121, 126, 127, 135; 128/25 R

[56] References Cited

U.S. PATENT DOCUMENTS 2,251,120 7/1941 Davis ..... 272/72

4,059,265 11/1977 Wieder et al. ..... 272/143

4,251,070 2/1981 Leseberg ..... 272/143

*Primary Examiner*—Richard J. Apley

*Assistant Examiner*—Kathleen D'Arrigo

*Attorney, Agent, or Firm*—Bauer & Amer

[57] ABSTRACT

A rowing exercise device in which the heretofore individually operated right and left hand rowing or exercise handles are now, according to the within invention, also optionally operated in unison, by the exerciser gripping a handle-uniting structure connected in spanning relation between the hand grips of the exercise handles, and wherein the handle-uniting structure counter-rotates to obviate slippage in the exerciser's grip.

3 Claims, 4 Drawing Figures

ROWING EXERCISE DEVICE

The present invention relates generally to improvements for a rowing exercise device wherein, more particularly, the improvements double the exercise force, at the option of the exerciser, as well as providing other noteworthy benefits.

It is already well known to provide exercise devices in which the exercise routine is simulated rowing, and against which the resistance force may typically be varied up to twenty pounds, for each hand. It is now possible according to the present invention to double this resistance force, with an effectively and readily attached handle-uniting structure which brings into play both of the right and left hand resistance forces. With this increased resistance force, however, the exercise handles must be gripped and operated differently, or else the device will not function properly. For example, because only simulated rowing is involved, the exercise hand grips are not in the plane of what would be the oar locks or pivot points, as is the case with actual rowing, and thus during the pivotal traverse of the exercise handles a grip adjustment must be made to allow for this discrepancy. This is particularly so when exercising against a significantly increased resistance force.

Broadly, it is an object of the present invention to provide a rowing exercise device with a significantly increased range of resistance force, in which it has an operating mode appropriate for each selected resistance force, thus overcoming the foregoing and other shortcomings of the prior art. More particularly, it is an object to include provision in an exercise rowing device not only for significantly increasing the resistance force, but also for the manner of gripping and operating the rowing handles at the increased force, thus resulting in the proper exercising use thereof at all levels of force resistance.

In connection with an exercise device of the type having a pivotally mounted pair of right and left exercise handles and a cooperating resistance cylinder operatively connected to each for requiring the exerciser to independently urge each said handle through a pivotal traverse against the resistance of each said resistance cylinder during the exercising use of said exercise device, the within inventive improvement is one which increases the resistance during a single pivotal traverse of said exercise handles to the combination of both said resistance cylinders. More particularly, an improvement which demonstrates objects and advantages of the present invention includes in each said exercise handle a hollow gripping end so as to bound a pair of cylindrical compartments in opposing relation to each other when said exercise handles are in a starting position preparatory to being urged through said pivotal traverse. In carrying out the invention a cylindrical handle-uniting bar having opposite ends sized to be projected into said cylindrical compartments is so positioned, and is thus in spanning relation between the exercise handles. A detent means in each projected end of the handle-uniting bar is provided for establishing an engaged relation thereof to the exercise handles. Before this is done, however, a slightly oversized cylindrically shaped additional gripping handle is disposed over the handle-uniting bar and is therefor centered between the gripping ends of the exercise handles. As a consequence, the additional gripping handle is adapted to be gripped in both hands of the exerciser and will undergo a counter-rotation to the direction of the pivotal traverse about the handle-uniting bar which, in practice, has been found to contribute to obviating any slippage in the exerciser's grip during a pivotal traverse of the handles.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
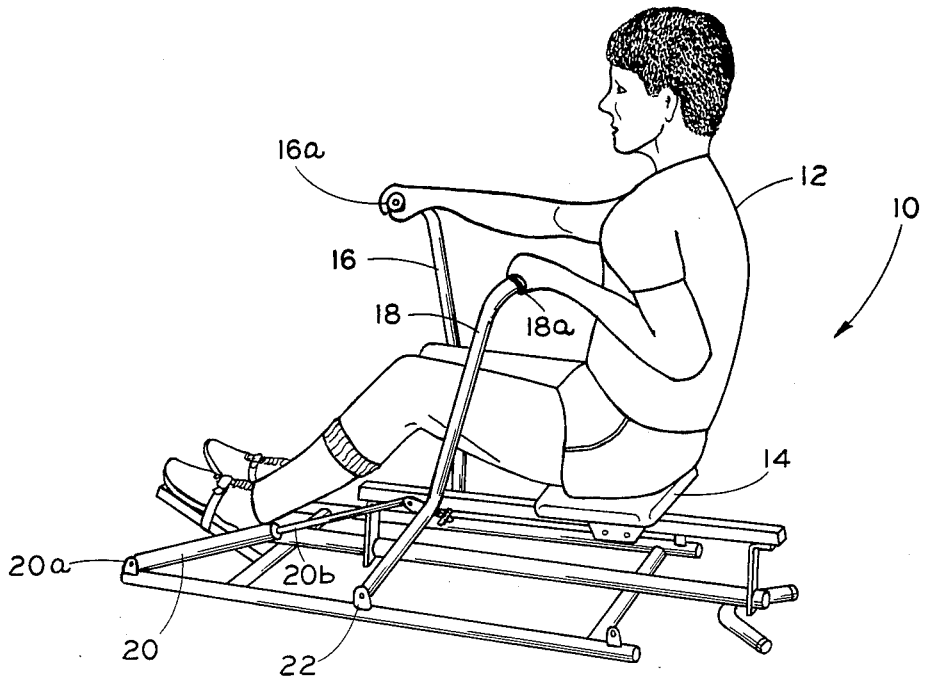
Fig. 1 PRIOR ART
FIG. 1 is a perspective view of a prior art exercise rowing device illustrating typical exercising use thereof.

Shown in FIG. 1 is a prior art exercise device, generally designated 10, in which the exercise is simulated rowing and in the performance of which exercise, an exerciser 12 while seated at 14, urges through exercise movements right and left hand exercise handles 16 and 18 against the resistance of a resistance cylinder 20 appropriately connected to each of the handles.

As is well understood, each resistance cylinder 20 has an outer cylindrical housing which is connected to the frame of the device 10, as at 20*a*, and a piston rod 20*b* connected at an appropriate location, as at 20*c*, above the pivot 22 of the handles 16 and 18, such that the urging by the exerciser 12 of the handles 16 and 18 through an exercising pitoval traverse is against the resistance of the piston 20*b* being withdrawn from the resistance cylinder 20. This resistance may be hydraulic or air pressure which impedes the movement of the piston operating within the cylinder 20 and which is attached to the piston rod 20*b*, or it may be a helical spring which is compressed during withdrawal of the piston rod 20*b* from the cylinder 20. In either case, each resistance cylinder 20 typically is designed to offer a resistance of twenty pounds against the pivotal traverse of each exercise handle to which it is cooperatively operatively attached.

In accordance with the present invention, an option is provided of uniting the exercise handles 16 and 18 during an exercise pivotal traverse thereof, so that the resistance that has to be overcome by the exerciser 12 is twice that of the resistance cylinders 20 attached to the exercise handles 16 and 18. In providing this additional exercising mode the handle-uniting structure, generally designated 30, also uniquely solves problems associated with the proper handling of the increased resistance force. One such problem, for example, is that the handles 16 and 18, when pulled in unison against the increased force, should be gripped directly in front of the exerciser 12, rather than at slightly laterally displaced locations as illustrated in FIG. 1. This problem is solved by the hand-uniting structure 30 being connected in spanning relation between the normal handgrips 16*a* and 18*a* of the handles 16, 18 and thus being readily gripped in the area thereof denoted by the reference arrow 32, which is in the required position immediately forward of the exerciser 12.

Another problem solved is related to the simulation of rowing which is produced by the device 10, and which is accentuated when the rowing exercise is against the increased force of the two cylinders 20. During actual rowing, each hand grip 16*a*, 18*a* would be in the plane of the oar, and thus in the plane of the oar lock or pivot point. On the device 10, however, the hand grips 16*a* and 18*a* are significantly removed from the pivot points 22 of the handles 16 and 18, and thus, during the pivotal traverse 16*b* and 18*b* of each handle, particularly when the handles are operated in unison, there is a counter-rotative movement, designated 34 in FIG. 2, which is required. This movement should be either in the grip that the exerciser 12 has on the structure 30 or, as a much more desirable alternative, there should be provision in the structure 30 to produce this counter-rotative movement 34 without any slippage occurring in the grip that the exerciser 12 has on the structure 30. The availability of a counter-rotative movement 34 to counteract the geometry of the pivotal traverses 16*b* and 18*b* of the handles 16 and 18 is thus part of the uniqueness of the handle-uniting structure 30 according to the present invention, and will now be described in relation to FIGS. 3 and 4 in conjunction with FIG. 2.

It will be understood that each exercise handle 16 and 18 is a hollow, tubular structure and that at the grip ends 16*a* and 18*a* thereof, they thus provide compartments 36 in facing relation to each other. Appropriately sized to be projected into the compartments 36 is a handle-uniting cylindrical bar 38 which at each opposite end has a spring-biased detent means 40. More particularly, the means 40 consists of a leaf spring 40*a* and a detent projection 40*b* which is urged under spring bias through an appropriate opening at the end of the bar 38 and also through an appropriate aligned opening in each of the hand grips 16*a* and 18*a*. As is well understood, the detent projection 40*b* is thus effective in preventing inadvertent disengagement of the bar 38 from the exercise handle compartments 36.

Figure 3:
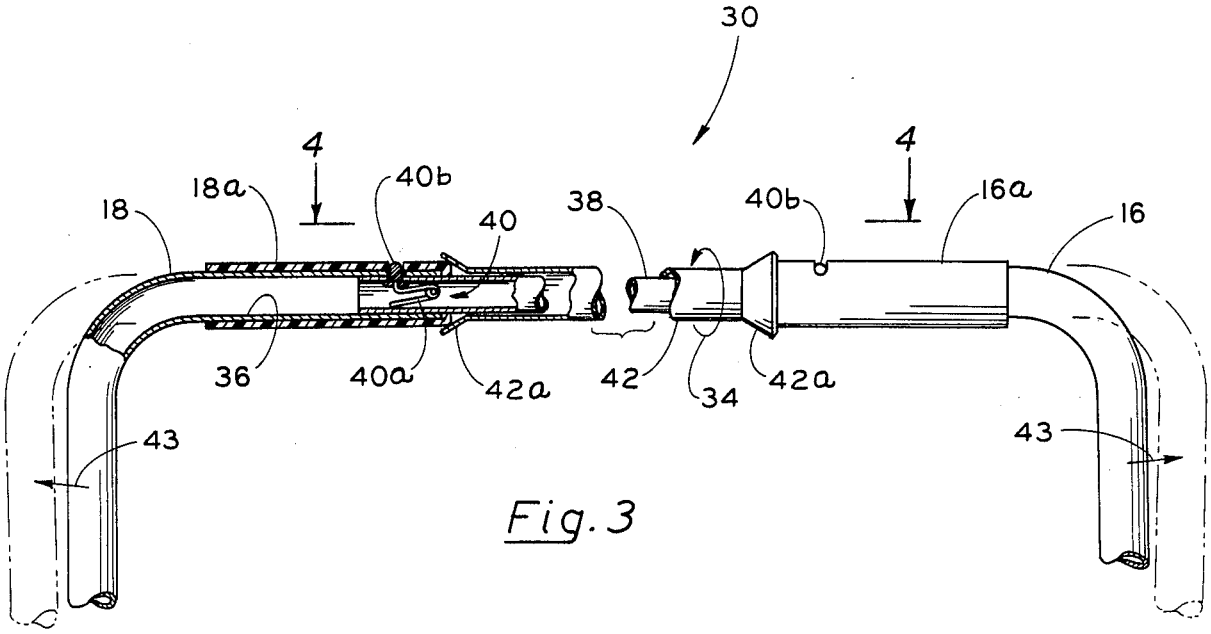
FIG. 3 is an isolated partial view, partly in section, illustrating details of the handle-uniting structure and illustrating lateral positions of movement of the exercise handle in phantom perspective.
Figure 4:
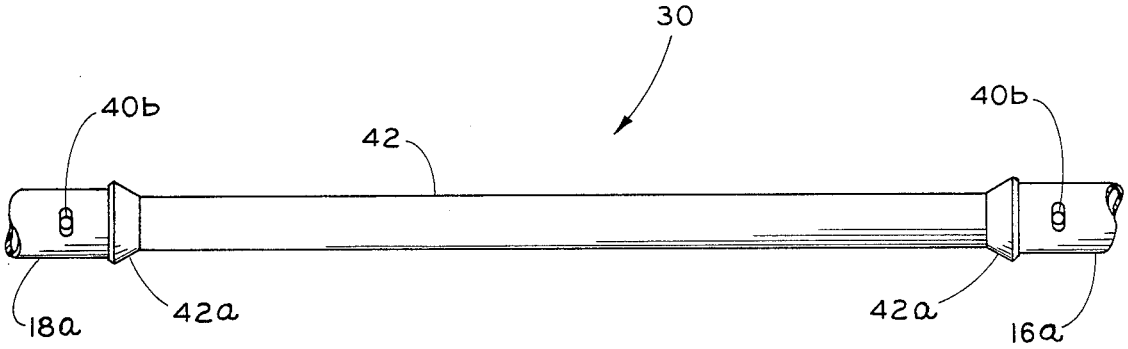
FIG. 4 is a further elevational view of the handle-uniting structure according to the present invention as seen along lines 4–4 of FIG. 3.

To assist in initially placing the bar 38 in spanning relation between the grips 16*a* and 18*a*, and because the length of the bar 38 is slightly greater than the distance between the ends of the hand grips 16*a* and 18*a*, the exercise handles 16 and 18 are displaced slightly outwardly from each other in the opposite directions 43, from the full line into the phantom line positions as illustrated in FIG. 3. As is well understood, the length of the handles 16 and 18 and the normal manufacturing clearances in the pivot points 22 of these handles will readily permit using to advantage the lateral displacement movement 43 in achieving placement of the handle-uniting bar 38 in the hollow ends of the exercise handles 16 and 18.

In accordance with the present invention, disposed in encircling relation about the bar 38 and slightly oversized in relation to the bar 38 is an external sleeve-like member 42 having flared opposite ends 42*a*. It should be readily appreciated that the slight oversize in diameter of the sleeve 42 relative to the bar 38 allows for the counter-rotation 34 during operation of the exercise handles 16 and 18 in unison, as previously described. That is, during exercise use of the device 10, it is contemplated that the exerciser 12 will grip the sleeve 42 between its flared ends 42*a*, and thus in the central area 32, and when urging these exercise handles in unision through a pivotal traverse 16*b*, 18*b*, there will be a slight counter rotation 34 in the sleeve about the bar 38, rather than any slippage in the exerciser's grip on the sleeve 42. The flared ends 42*a* of the sleeve prevent sliding movement thereof lengthwise of the bar 38 while not impeding the counter-rotative movement 34. Although not shown, it will be understood that the sleeve 32 may advantageously be provided with an external pad or elastomeric sleeve to assist in providing a firm and comfortable grip for the exerciser.

Figure 2:
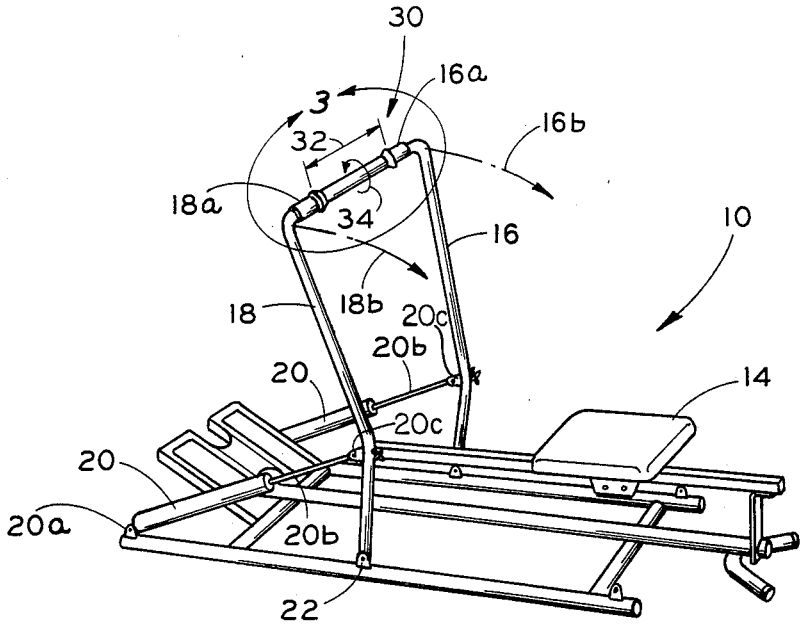
FIG. 2 is similarly a perspective view of a rowing device, but illustrating the use thereon of a handle-uniting structure in accordance with the present invention.

Although it is contemplated that the handle-uniting structure 30 will be gripped by the two hands of the exerciser during normal use, it is, of course, within the contemplation of the present invention that it be used in a one-arm exercise routine in which only one resistance cylinder is used when the device is in the prior art mode of FIG. 1, and in a double resistance cylinder 20 set-up when used in the inventive mode of FIG. 2.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. In an exercise device of the type having a pivotally mounted pair of right and left exercise handles and a cooperating resistance cylinder operatively connected to each for requiring the exerciser to independently urge said said handle through a pivotal traverse against the resistance of each said resistance cylinder during the exercising use of said exercise device, the improvement comprising in each said exercise handle a hollow gripping end in opposing relation to each other when said exercise handles are in a starting position preparatory to being urged through said pivotal traverse, a cylindrical handle-uniting bar having opposite ends sized to be projected into said hollow gripping ends of said exercise handles and having such operative positions in said hollow gripping ends when in spanning relation between said exercise handles, a detent means in each projected end of said handle-uniting bar for establishing an engaged relation thereof to said exercise handles, and a slightly oversized cylindrically shaped additional gripping handle disposed over said handle-uniting bar and centered between said gripping ends of said exercise handles, whereby said additional gripping handle is adapted to be gripped in both hands of the exerciser and undergo counter-rotation to the direction of the pivotal traverse about said handle-unit bar, so as to contribute to obviating any slippage in the exerciser's grip thereof during said pivotal traverse.

2. The improved double cylinder exercise device as claimed in claim 1, wherein said additional gripping handles has outwardly flared opposite ends for maintaining its centered position between said gripping ends of said exercise handles without impeding its said counter-rotation movement about said handle-uniting bar.

3. In an exercise device of the type having a pivotally mounted pair of right and left exercise handles and a cooperating resistance cylinder operatively connected to each for requiring the exerciser to independently urge each said handle through a pivotal traverse against the resistance of each said resistance cylindrical during the exercising use of said exercise device, the improvement comprising in each said exercise handle a hollow gripping end in opposing relation to each other when said exercise handles are in a starting position preparatory to being urged through said pivotal traverse, a cylindrical handle-uniting bar having opposite ends sized to be projected into said hollow gripping ends of said exercise handles and having such operative positions in said hollow gripping ends when in spanning relation between said exercise handles, means in each projected end of said handle-uniting bar for establishing an engaged relation thereof to said exercise handles, and a slightly oversized cylindrically shaped additional gripping handle disposed over said handle-uniting bar and centered between gripping ends of said exercise handles, whereby said additional gripping handle is adapted to be gripped in both hands of the exerciser and undergo counter-rotation to the direction of the pivotal traverse about said handle-uniting bar, so as to contribute to obviating any slippage in the exerciser's grip thereof during said pivotal traverse.

* * * * *